United States Patent [19]

Beery

[11] Patent Number: 4,848,762

[45] Date of Patent: Jul. 18, 1989

[54] SHEET FEEDER WITH ARTICULATED FEED PADS

[75] Inventor: Jack Beery, Centerville, Ohio

[73] Assignee: The Mead Corporation, Dayton, Ohio

[21] Appl. No.: 168,812

[22] Filed: Mar. 16, 1988

[51] Int. Cl.[4] ..... B65H 3/02

[52] U.S. Cl. ..... 271/19; 271/33; 271/42; 271/161; 414/796.9; 221/210

[58] Field of Search ..... 221/210, 259; 271/19, 271/33, 18.3, 42, 128–130, 161; 414/117, 118, 120

[56] References Cited

U.S. PATENT DOCUMENTS

| | | | |
|---|---|---|---|
| 1,511,714 | 10/1924 | Beadle | 271/24 |
| 1,964,498 | 6/1934 | Grasseur | 271/161 |
| 3,989,237 | 11/1976 | Goff, Jr. et al. | 271/19 |
| 4,192,498 | 3/1980 | Toto | 271/21 |
| 4,223,884 | 9/1980 | Burnham et al. | 271/21 |
| 4,269,404 | 5/1981 | Webb | 271/42 |
| 4,394,010 | 7/1983 | Hogenson | 271/22 |

FOREIGN PATENT DOCUMENTS 1244495 2/1968 United Kingdom .

*Primary Examiner*—Joseph J. Rolla
*Assistant Examiner*—Steve Reiss
*Attorney, Agent, or Firm*—Biebel, French & Nauman

[57] ABSTRACT

A sheet feed mechanism for feeding single sheets from a stack of sheets in a feed tray is adapted to feed such sheets, even though the sheets may be bowed, curved, or wavy in a direction transverse to the process or feed direction. The mechanism includes a pad support body. A plurality of individual sheet-engaging pressure pads are mounted on a lower surface of the body by connecting webs. The connecting webs have a fore and aft axis in the process direction and bend to permit the individual pads to move in the transverse direction so that the lower friction surface of the pad will conform to the non-planar or curved surface of the sheet to be fed from the stack of sheets.

5 Claims, 2 Drawing Sheets

SHEET FEEDER WITH ARTICULATED FEED PADS

BACKGROUND OF THE INVENTION

The copending application of Beery, Ser. No. 125,841 filed Nov. 17, 1987 discloses a sheet or paper feed mechanism for feeding single sheets from a stack of sheets by employing a relatively low sheet contact force to prevent marking of soft coated sheets. As stated in that copending application, an example of sheets which are soft coated and subject to damage by excessive localized pressure, is the receiver sheet described in U.S. Pat. No. 4,399,209. Such sheets may also have a resin coating for glossing, and thus may be formed of multiple layers.

Under particular conditions of humidity, such sheets may tend to curl, buckle, or assume a wavy condition. Any such lack of flatness increases the difficulty of properly engaging and feeding the top sheet or the exposed sheet from a stack of such sheets. Conventional sheet feed mechanisms are likely to skip or fail since they tend to lose contact with such as a curbed sheet.

SUMMARY OF THE INVENTION

This invention provides a sheet feed apparatus which is particularly adapted for the feeding of single sheets from a stack of sheets, and in which the sheets are bowed or curled in a direction transverse to the feed direction. The invention has particular utility in the feeding of easily marked or damaged sheets, having soft coatings, as disclosed and described above, but may be used with advantage in any sheet feeder in which the sheets may be bowed, buckled, or curled.

The feed mechanism of this invention provides a plurality of individual pressure pads, carried on a common pad support body. The individual pads are articulated with respect to the pad support body and have controlled pivotal or rocking movement on the body from a co-planar condition in a direction transverse to the feed direction. The pad support body is movable to bring a friction surface of the pads into engagement with the top sheet of a stack of sheets. The articulated mounting of the pads to the pad support body permits controlled transverse tilting or rocking movement of the individual pads with respect to the body, to conform to the surface of the top sheet, while the mounting is very stiff in the feed direction.

The articulated mounting may preferably consist of flexible connector webs for each of the pads. Each web has an upper edge attached a lower surface of the support body, and a lower edge attached to the pad, and provides for the relative tilting movement of the pad in a direction transverse to the feed direction. The web substantially prevents pitching movement of the associated pad in the process direction parallel to the feed movement.

It is accordingly an important object of this invention to provide a sheet feed mechanism for feeding sheets from a stack of sheets, in which a plurality of individual feed pads, having sheet-engaging surfaces, are mounted for articulation on a common support body.

Another object of the invention is the provision of a sheet feed mechanism particularly adapted for feeding sheets which may be curled, wavy, or otherwise non-planar from a stack of such sheets.

It is also an object of this invention to provide a sheet feed mechanism with articulated feed pads, in which the pads may move or tilt transverse to the feed direction with relative freedom and which are supported in the feed directio with relatively high rigidity.

A further object of the invention is the provision of a sheet feed mechanism, as outlined above, in which individual sheet-engaging friction pads are connected by webs to a support body, and in which the longitudinal axes of the webs are oriented generally parallel to the feed direction, thereby providing relative rigidity to the individual pads in the feed direction while permitting tilting movement of the pads in a direction transverse to the feed direction. In this manner the pads may tilt to conform to a curled or warped surface of a sheet.

These and other objects and advantages of the invention will be apparent from the following description, the accompanying drawings and the appended claims.

SUMMARY OF THE INVENTION

Figure 1:
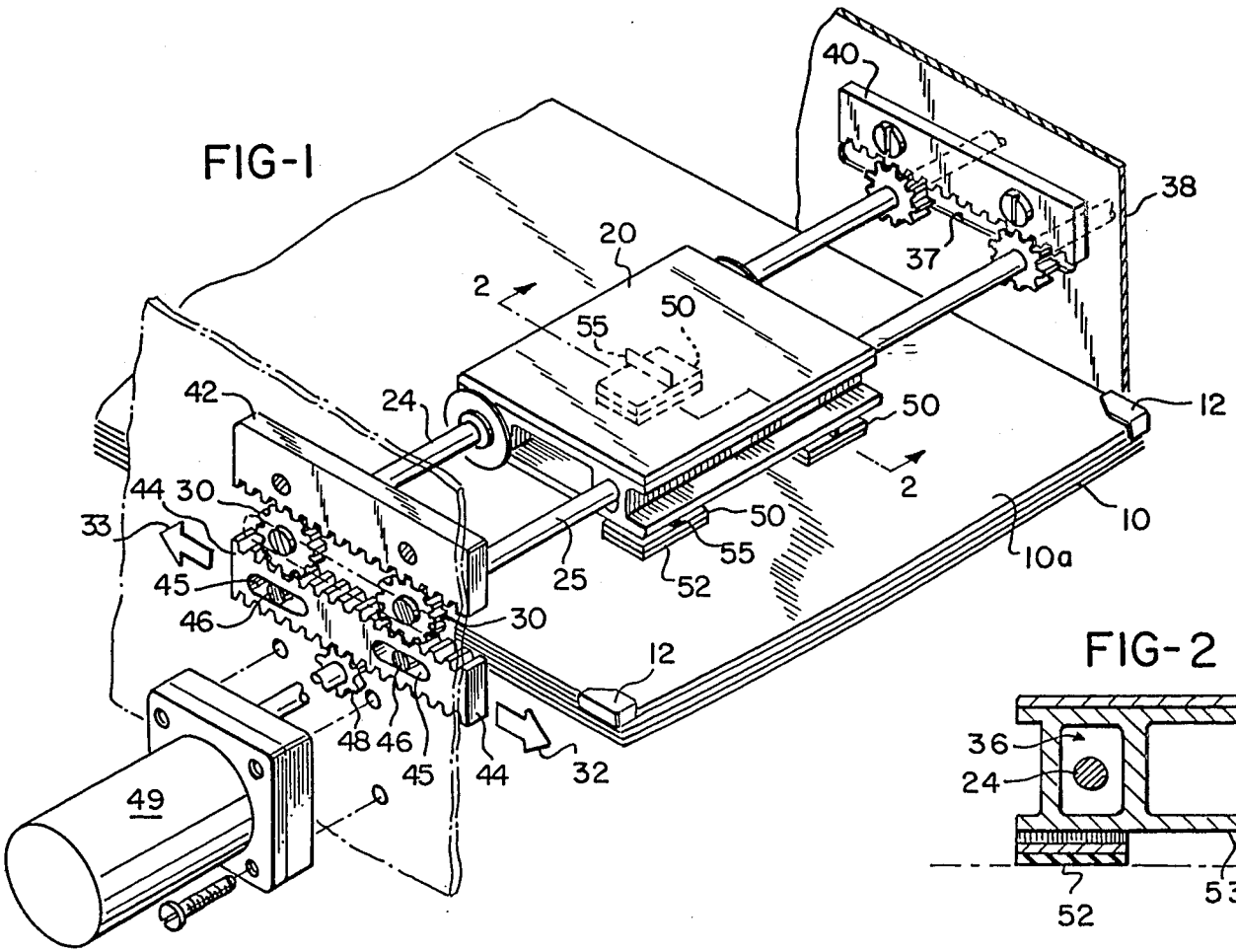
FIG. 1 is a perspective view, partially broken away, of a sheet feed mechanism according to this invention.

This invention is shown as being applied to a sheet feed mechanism of the general kind described and claimed in the embodiment of FIGS. 5 and 6 of the above-identified copending application Ser. No. 125,841, the disclosure of which is specifically incorporated herein by reference. Thus, FIG. 1 illustrates a bi-directional feed mechanism in combination with a stack 10 of sheets, in which the top sheet 10*a* is separated and delivered from the stack 10. For the purpose of this invention it may be assumed that the stack 10 of sheets is mounted on an elevator tray, not shown, and the top sheet 10*a* is temporarily retained by corner snubbers 12 in a forward feeder. Snubbing and sheet delivery apparatus of conventional construction employing corner snubbers is shown for example, in U.S. Pat. No. 3,713,645 issued Jan. 30, 1978, in which a conventional feed wheel causes a top sheet in a tray of sheets to be buckled forwardly against the snubbers for separation from the second and subsequent sheets in the stack of sheets. While the invention is described particularly in connection with a snubber-type of sheet feeder, in which single sheets are delivered, it will be understood that the concepts and principles disclosed and described herein may be used with other kinds of sheet feeders, such as a shingle feeder, in which a number of sheets are shingled or feathered forwardly from a stack, in a sheet feeder without corner snubbers.

In the above-identified copending application, marking of the underlying sheets is avoided by providing a feed mechanism in which there is a substantial area of contact between the feed mechanism and the stack, and in which the feed mechanism itself is caused to move in translation in a direction generally parallel to the top sheet 10*a* for gently urging the top sheet off the stack. For this purpose, the primary sheet-feeding mechanism includes a friction pad support body 20 mounted on a bi-directional drive. The bi-directional drive includes a pair of transversely oriented shafts 24 and 25, each of which respectively terminates in a spur gear 28 at one end and a spur gear 30 at the other end. The shafts 24 and 25 are parallel to each other and are mounted for concurrent linear motion in a direction generally parallel to the feed direction of the top sheet 10*a*, as represented by the arrows 32 and 33.

Figure 2:
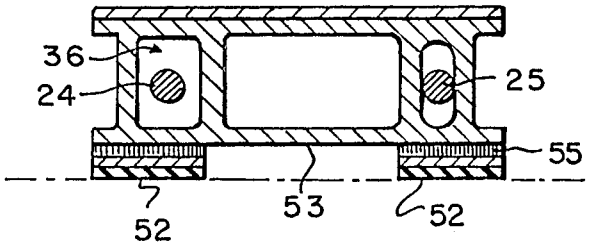
FIG. 2 is a transverse sectional view through the sheet delivery mechanism taken generally along the line 2—2 of FIG. 1.

The shafts 24 and 25 extend through access openings in the support body 20, as best illustrated in FIG. 2, and provide the means for supporting the pad support body 12 above the stack 10. Thus, as shown in FIG. 2, the forward shaft 24 passes through a narrow, generally vertically oriented slot 35 in the body 20 and forms a relatively close fit with the vertical parallel side walls of the slot. The shaft 24 is free to move vertically of the slot 35 within the limits of the slot, and acts as a driver for the pad support body 20. The rear shaft 25, on the other hand, passes through a clearance opening 36 in the body 20 so that the body 20 is free to move somewhat with respect to the shaft 25. In this manner, the weight of the body 20 may freely rest on the stack 10 during the sheet feeding operation, but when the stack 10 is lowered, the body 20 will be carried on the respective shafts 24 and 25:

The extended far ends of the shafts 24 and 25 move in a slot 37 formed in the end plate 38 and the spur gears 28 engage the teeth of stationary rack 40 on the plate 38*a* alongside the slot 37. The gears 28 may roll along the rack 40 while the shafts are supported at the slot 37.

The upper rack 42 is similarly mounted to a side wall 43 and in engagement with the spur gears 30. A lower double-sided rack 44 engages the gears 30 and is slotted at 45 for limited reciprocal movement on guide pins 46 in the direction of the arrows 32 and 33. The lower rack 44 is also in running engagement with a drive spur gear 48 of a gear reduction drive motor 49 which is mounted on the side wall 43. The motor 49 is operated to cause shifting movement of the double-sided rack 44, and through the rack, corresponding movement of the shafts 24, 25, and the body 20 carried thereon.

As noted above, the invention provides for the accommodation of the delivery of sheets from a stack of sheets in which the top sheet has a curl or otherwise is not in flat relation to the body 20. The pad support body 20 is provided with a plurality of individual friction pressure pads 50 attached to the lower surface. Each of the pads 50 has a lower sheet-engaging fricton layer 52 thereon for engagement with the top sheet 10*a*.

Figure 3:
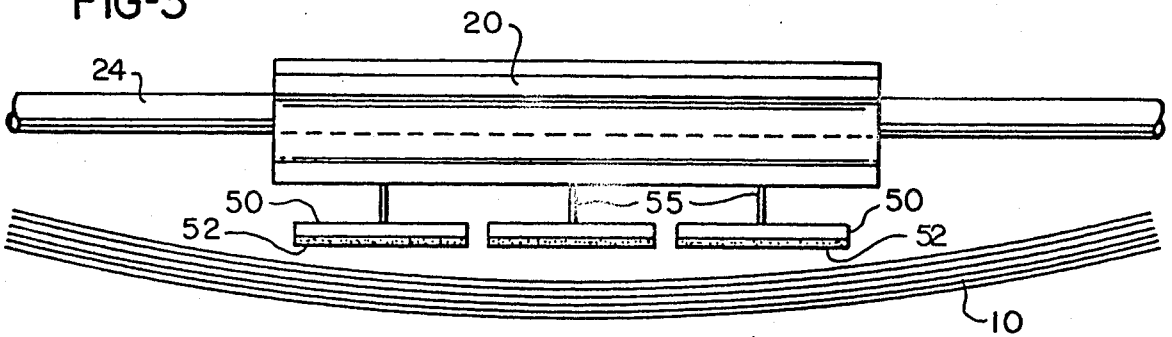
FIG. 3 is a somewhat diagrammatic end view of the sheet feed mechanism looking in the sheet-feeding direction and showing the pads prior to contact with the stack.

The pads 50 are mounted to the bottom 53 of the body 20 (FIG. 2) by articulating means in the form of connector webs 55. The connector webs 55 form flexible connectors for the pads 50 which are flexible in a direction transverse to the feed direction, and which are very stiff in the process direction. Each web 55 has an upper end which is suitably bonded or attached to the body 20 at the surface 53, and has a lower end which is suitably bonded or attached to the upper surface of one of the pads 50. The pads 50 are normally positioned on the body 20 with their friction surfaces 52 in co-planar relationship and parallel to the stack 10 as shown in FIG. 3.

Figure 4:
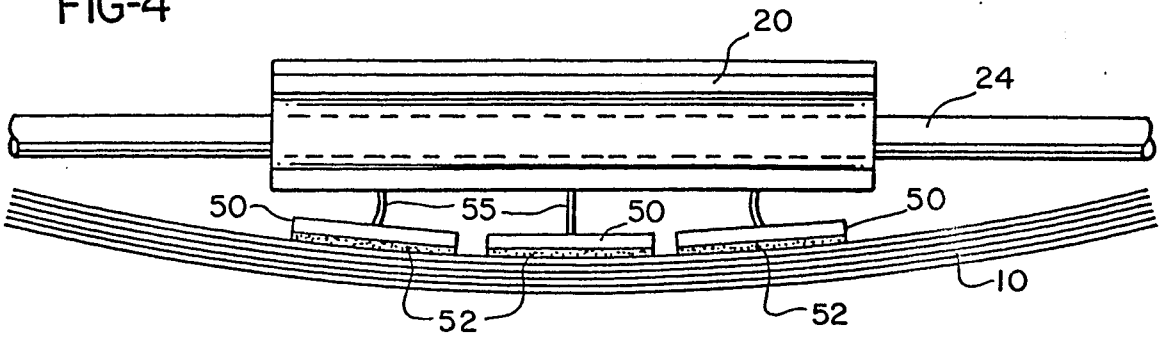
FIG. 4 is a view similar to FIG. 3 showing the pad support body and the articulated pads thereon after contact with the stack.

The fore and aft orientation of the flexible connecting web 55, for each of the individual pads 50, is generally parallel to the direction of movement of the body 20 when feeding sheets in the stack 10. Accordingly, the pressure pads 50 are supported substantially against pitching movement in the feed direction. However, the connecting webs 55 are sufficient flexible, to permit the pads 50 to conform under the weight of the body 20, as shown in FIG. 4 to the sheet surface. This, when the stack presents to the feed mechanism a sheet surface which is other than coplanar with the surfaces of the pads, the pads may deflect, as shown in FIG. 4, so as to conform to the surface. While FIGS. 3 and 4 show a bowed configuration with the concavity facing upwardly, and the bow extending transversely to the feed direction, it will be understood that the bow may be reversed from that shown in FIG. 3 with the high portion at the center, or may be wavy.

Preferably three or more pads 50 are employed. In FIG. 1, two pads 50 are at leading or front edges of the body, and one pad is at the rear edge or trailing edge. Bowing or deflection of the stack 10 in a direction parallel to the process direction, as represented by the arrows 32 and 33, is accommodated by the fact that the pad support body 20, itself can conform in the feed direction by reason of the relative freedom of movement of the body 20 on the support shafts 24 and 25. The articulated means in the form of the webs 50 connecting the pads 50 to the body 20, as shown in FIGS. 3 and 4, assures full contact of the friction surfaces 52 with the upper sheet 10 in a transverse bowed or curled condition, as illustrated in FIG. 4. The flexible connecting webs 55 provide very stiff support for the pads 50 in the process direction, since it is important that the sheets be fed in a process direction which is either parallel to the plane of the paper in the stack or in an otherwise defined plane or pitch relation to the stack. This should not vary from sheet to sheet The ability of the individual pads 50 to conform their respective friction surfaces 52 to a transverse curl provides full or substantially full contact between the paper feed mechanism and the sheet where there would otherwise be limited contact, with conventional feed mechanism.

In the operation of the invention, sheet material is loaded in the stack and, in a feeding cycle, is elevated into contact with the feed mechanism represented by the body 20 and the friction pads 50. The motor 49 is operated to drive the double-sided rack 44 so as to carry the body 20, on the shafts 24 and 25, in the feed direction 32. In the elevated position of the stack 10, the weight of the body 20, including the articulated pads 50, is carried on the upper surface of the top sheet 10*a* with the weight distributed over the area of the three pads so as to prevent marking as more fully described and identified in copending application Ser. No. 125,841 above. The articulated supports in the forms of the webs 55 permit the individual pads 50 to deflect from the coplanar relationship as shown in FIG. 3 to a deflected position as shown in FIG. 4 to conform to a bow or curvature of the stack, or of the first sheet in the stack as necessary, to provide full or substantially full feeding contact between the exposed surface of the sheet 10*a* and the friction surfaces 52.

The webs 55 form a relatively stiff and strong beam in the feed direction, and thus the accurate delivery and feeding of the sheet 10*a* is assured.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A sheet feed mechanism having pressure pads thereon for feeding single sheets from a stack of such sheets in a tray or the like, and in which at least the top sheet is bowed in a direction transverse to the direction of feed from said stack of sheets, comprising:

a pad support body, a plurality of individual pressure pads each having a lower generally planar sheet engaging surface, each of said pads being rigid in the feed direction, articulating means connecting said pads to said pad support body providing for limited tilting movement of each of said pads in said transverse direction while providng a high degree of stiffness against pad movement independently of said pad support body in said feed direction, means bringing said pads thereon into engagement with said top sheet accompanied by transverse aligning movement of said pads as necessary on said articulating means to conform to the bowed surface of said top sheet, and means for moving said pad support body relative to said stack while said pads are so engaged to provide for movement of said top sheet relative to said stack.

2. The sheet feed mechanism of claim 1 in which said articulating means comprises a flexible connector web for each of said pads, each said web having an upper end attached to said body and a lower end attached to said pad, each said web having a fore and aft orientation generally parallel to the sheet feeding direction.

3. The sheet feed mechanism of claim 2 further comprising:

said means for bringing said pads into engagement with said top sheet providing for the weight of said pad support body and pads to be applied to said top sheet, said pad support body being movable by said support means in a plane parallel to said top sheet.

4. A sheet feed mechanism for feeding single sheets from the top of a stack of sheets in a tray, and in which at least said top sheet is bowed transversely to the direction of sheet feeding, comprising:

a pad support body, pad support drive means connected to said pad support body adapted to move said pad support body in said feed direction parallel to the direction of sheet feeding, a plurality of individual sheet feeding friction pads, said pads each having lower sheet-engaging surfaces, each of said pads being rigid in the feed direction, means mounting said pads to a lower surface of said support body, said pad mounting means normally supporting said pads with their lower surfaces in a common sheet engaging plane, said mounting means enabling each said pads to articulate in a direction transverse to said feed direction while preventing movement in a pitch direction, whereby said pad surfaces may be transversely deflected from said common plane when in engagement with said bowed top sheet.

5. The mechanism of claim 4 in which said pad mounting means includes webs, at least one for each of said pads, each of said webs having an upper edge connected to said pad support body and a lower edge connected to the associated said pad, said webs being oriented generally parallel to said feed direction.

* * * * *